US011166488B2

(12) United States Patent
Zappoli et al.

(10) Patent No.: US 11,166,488 B2
(45) Date of Patent: Nov. 9, 2021

(54) METHOD AND APPARATUS FOR SHAPING SUBSTANTIALLY FLAT CONTINUOUS MATERIAL

(71) Applicant: PHILIP MORRIS PRODUCTS S.A., Neuchatel (CH)

(72) Inventors: Stefano Zappoli, Bologna (IT); Gianni Caprini, Zola Predosa (IT); Michele Pagnoni, San Giovanni in Persiceto (IT)

(73) Assignee: Philip Morris Products S.A., Neuchatel (CH)

( * ) Notice: Subject to any disclaimer, the term of this patent is extended or adjusted under 35 U.S.C. 154(b) by 149 days.

(21) Appl. No.: 16/707,180

(22) Filed: Dec. 9, 2019

(65) Prior Publication Data

US 2020/0113226 A1 Apr. 16, 2020

Related U.S. Application Data

(62) Division of application No. 15/527,145, filed as application No. PCT/EP2015/080044 on Dec. 16, 2015, now Pat. No. 10,512,280.

(30) Foreign Application Priority Data

Dec. 16, 2014 (EP) ..... 14198336

(51) Int. Cl.
*A24D 3/02* (2006.01)

(52) U.S. Cl.
CPC ..... *A24D 3/0233* (2013.01); *A24D 3/0229* (2013.01); *A24D 3/0258* (2013.01); *A24D 3/0266* (2013.01)

(58) Field of Classification Search
CPC ... A24D 3/0233; A24D 3/0258; A24D 3/0266
See application file for complete search history.

(56) References Cited

U.S. PATENT DOCUMENTS

| | | | |
|---|---|---|---|
| 2,164,702 | A | 7/1939 | Davidson |
| 2,873,965 | A | 2/1959 | Mitchell |
| 2,963,716 | A | 12/1960 | Norehad |
| 3,002,876 | A | 10/1961 | Rosati |
| 3,095,343 | A | 6/1963 | Berger |
| 3,161,557 | A | 12/1964 | Muller |

(Continued)

FOREIGN PATENT DOCUMENTS

| | | |
|---|---|---|
| CH | 670420 | 6/1989 |
| CH | 691156 | 5/2001 |

(Continued)

OTHER PUBLICATIONS

Office Action issued in Japan for Application No. 2017-531530 dated Feb. 25, 2020 (4 pages). English translation included.

(Continued)

*Primary Examiner* — James Sanders
(74) *Attorney, Agent, or Firm* — Mueting Raasch Group

(57) ABSTRACT

The apparatus for shaping substantially flat continuous material comprises a shaping device for gathering substantially flat continuous material transverse to a longitudinal direction of the continuous material to form a gathered continuous material. The apparatus further comprises a cooling device for cooling the gathered continuous material. The shaping device and the cooling device are combined such as to immediately cool the gathered continuous material.

16 Claims, 6 Drawing Sheets

(56) References Cited

U.S. PATENT DOCUMENTS

| | | | |
|---|---|---|---|
| 3,313,665 | A | 4/1967 | Berger |
| 3,560,298 | A | 2/1971 | McArthur |
| 3,818,809 | A | 6/1974 | Sylvester |
| 3,831,501 | A | 8/1974 | Bevington, Jr. |
| 6,723,033 | B1 | 4/2004 | Scott |
| 2013/0085052 | A1 | 4/2013 | Novak, III |
| 2014/0171281 | A1 | 6/2014 | Park |

FOREIGN PATENT DOCUMENTS

| | | |
|---|---|---|
| EP | 2110031 | 10/2009 |
| GB | 1282173 | 7/1972 |
| JP | 2014525250 | 9/2014 |
| JP | 2014528242 | 10/2014 |
| WO | WO 2012164645 | 5/2011 |
| WO | WO 2013117620 | 8/2013 |

OTHER PUBLICATIONS

International Search Report and Written Opinion for PCT/EP2015/080044 dated Jun. 7, 2016 (17 pages).

METHOD AND APPARATUS FOR SHAPING SUBSTANTIALLY FLAT CONTINUOUS MATERIAL

This application is a divisional application of U.S. application Ser. No. 15/527,145 filed May 16, 2017 and which is a U.S. National Stage Application of International Application No. PCT/EP2015/080044, filed Dec. 16, 2015, which was published in English on Jun. 23, 2016, as International Publication No. WO 2016/097016 A1. International Application No. PCT/EP2015/080044 claims priority to European Application No. 14198336.1 filed Dec. 16, 2014. A certified copy of European Application No. 14198336.1 filed Dec. 16, 2014 was provided in, and is available in, U.S. patent application Ser. No. 15/527,145 for which certified copy is available in PAIR.

The invention relates to an apparatus and method for shaping substantially flat continuous material. In particular, it relates to an apparatus and method for shaping substantially flat continuous material used in the manufacture of aerosol generating articles or smoking articles.

Aerosol generating articles or their components such as for example, filter plugs or tobacco plugs may be manufactured at least partially from a substantially flat continuous material, such as a paper, tobacco or plastic web. Due to the special materials used for the production of these plugs, some processing steps in a processing line may provide additional challenges when handling such webs. For example, some plastic materials, such as, for example, polylactic acid webs, tend to be electrostatically charged and to be heated upon handling the web. This may lead to irregular folding, for example in a funneling of the web, reducing the reproducibility of the products to be manufactured from the web.

Thus there is a need for an apparatus and method for shaping substantially flat continuous material. In particular, there is a need for an apparatus and method for shaping substantially flat continuous material, which substantially flat continuous material may be used in the production of aerosol generating articles or smoking articles.

According to a first aspect of the invention, there is provided an apparatus for shaping substantially flat continuous material. Preferably, the substantially flat continuous material is for use in the manufacture of smoking articles or for consumables as may be used in electronic smoking devices. The apparatus comprises a shaping device for gathering substantially flat continuous material transverse to a longitudinal direction of the continuous material to form a gathered continuous material. The apparatus further comprises a cooling device for cooling the gathered continuous material. The shaping device and the cooling device are combined such as to immediately cool the gathered continuous material. To immediately cool the gathered continuous material is herein understood as cooling the substantially flat continuous material while gathering the substantially flat continuous material or immediately after the substantially flat continuous material has been gathered. To achieve such an immediate cooling, the cooling device may be integrated into the shaping device. By this, the gathered continuous material is cooled while being gathered in the shaping device. The cooling device may also be arranged next to the shaping device and downstream of the shaping device when seen in a transport direction of the substantially flat continuous material or of the gathered continuous material. In such embodiments, preferably, the gathered continuous material is cooled immediately after having been gathered in the shaping device.

Throughout the specification, the term "cooling" is used to refer to an active step to limit, maintain or reduce the temperature of the substantially flat continuous material or of an element that is in contact with the substantially flat continuous material or both, thus preventing the further increase of temperature of the substantially flat continuous material.

The terms "upstream" and "downstream" are used herein in view of the transport direction of the substantially flat continuous material in the apparatus or in individual elements of the apparatus.

The cooling of material in or by a cooling device while the material is or has just been gathered may prevent or reduce the heating up of the material upon gathering or reduce heat distribution in the material. Heating may for example be caused by friction, for example, while a web of material is gathered in a shaping device. Excess heat may change the specification of a material. In particular, materials having low glass transition temperatures or low melting temperatures or both may get tacky or may at least partially melt upon being heated up. If such a material with changed characteristics is gathered or formed, for example into a rod shape, individual folds may stick together or may fuse. By this, for example, a resistance to draw (RTD) of a plug formed by the material may be different from an intended value for the RTD and may in particular not be reproducible. In addition, a partially molten or tacky material may stick to apparatus parts. This may lead to apparatus blockage and may displace or damage the material. This may be prevented by the provision of a cooling device, by which the material may be cooled preferably such as to not exceed a critical temperature. In addition, the tensile strength of the material may be reduced by heating. This in turn may require to reduce the machine speed in order to prevent rupture of the material or may lead to machine stops and waste due to rupture of the material with reduced tensile strength. Cooling is therefore particularly advantageous for materials with a low glass transition temperature or low melting temperature, such as for example a web of polylactic acid. At the glass transition temperature or transformation temperature a solid material changes into the rubbery-elastic state and the solid material turns into a gummy and pasty melted material. For example, an amorphous or semi-crystalline plastics material may get tacky and may undergo changes in its stability. A transition to the rubbery-elastic state or yield range is continuous. At the glass transition temperature the material does not undergo a phase transition. Thus, the glass transition temperature is not related to an exact temperature but to a temperature range.

A substantially flat continuous material as used herein may be a web of material such as paper, tobacco or plastic web that may be used in the manufacture of smoking articles or in aerosol generating articles for electronic smoking devices. Preferably, the substantially flat continuous material is a continuous sheet of polylactic acid. Preferably, the substantially flat continuous material is formed into an endless rod for future manufacture of individual plugs. The substantially flat continuous material may have been pretreated before being formed in the apparatus according to the invention. A pretreatment may for example be crimping or embossing or both.

The term "gathering" is used throughout the specification to refer to a reduction in a width of the substantially flat continuous material. By the gathering the continuous material is reduced in a lateral direction of the material, thus transversal to the longitudinal and transport direction of the material. A gathering may, for example, be a longitudinal crimping, a providing of the material with a longitudinal overlaying undulating structure, a pushing together, a compression, a funnelling, a rod-shaping of the material or combinations of the aforementioned processes. A gathering includes a reduction in width of the substantially flat continuous material by, for example, a simple pushing the sides of the continuous material versus a longitudinal central axis of the continuous material. A gathering also includes a reduction in width by providing the continuous material with a micro structure and a macro structure, like for example, small crimps with an amplitude of about the thickness of the material and transverse undulations with an amplitude of about 10 times of the thickness of the material. Material that is required to form the structure leads to the reduced lateral extension of the continuous material. A gathering may be performed continuously or stepwise. A gathering may be performed in one or in several shaping devices. Typically, the reduction of the width of the material leads to an increase of the extension of the material in another dimension, for example normal to the web of substantially flat continuous material. However, in some embodiments, the material may be compressible in itself, for example a mesh- or a sponge-like material. In these embodiments of substantially flat continuous material a reduction of the width of the web of substantially flat continuous material results also or mostly in an increase of the density of the material.

A gathered material as used herein may be a partially gathered material or a final gathered material. Partially gathered material has a reduced width compared to the substantially flat continuous material as supplied to the apparatus according to the invention. Partially gathered material may also have a reduced width compared to a partially gathered material that has already passed a previous shaping device. Partially gathered material has a larger width than the width of a final shape of the continuous material. Preferably, a final shape is a rod-shape.

Cooling may, for example, be achieved by cooling an element of a cooling device and by a direct contact of the cooling element, for example having a contact surface, with the continuous material. Cooling via a cooling element may also support a gathering or shaping step. For example, the cooling element or a contact surface of the cooling element may comprise a shape for shaping the continuous material according to this shape or for retaining the continuous material in a specific shape. The cooling may, for example, also be integrated into the shaping device. A shaping device then also serves as cooling device.

Cooling a cooling element may, for example, be achieved by the provision of a cooling medium into or through the cooling device. A cooling medium may for example be a cooling gas or cooling liquid, such as for example air or water. Cooling of the continuous material may also be achieved by direct contact with a cooling medium, such as for example a gas stream. Direct contact with a cooling medium may be advantageously provided, for example, where space is limited or where a mechanical contact with the continuous material shall be prevented. Direct contact with a cooling medium may also be provided where an extent of cooling, for example changing cooling temperatures, shall be varied quickly. Direct cooling with a fluidic cooling medium, such as for example, air, preferably creates a fluid cushion, for example an air cushion between the substantially flat continuous material and a corresponding transport element, such that at the same time, the substantially flat continuous material is cooled and the friction between the transport element along the transport path of the substantially flat continuous material is reduced, such that heating of the substantially flat continuous material by friction is avoided or reduced.

Alternatively, or in addition, the cooling medium may be in the form of a Peltier element or of a surface that is in contact with a Peltier element. A Peltier element has the advantage that less or no depleatable cooling medium, such as for example air, needs to be provided in the cooling zone, thus simplifying the supply and removal of such an additional, depleatable cooling medium.

Preferably, the temperature of a cooling medium is chosen such that the cooled continuous material does not exceed a predefined high or maximum temperature. Preferably, a cooling is also adapted such that the cooled medium does not fall below a predefined low or minimum temperature. With too low temperatures a cooling loop may possibly not show optimum performance. In addition, a continuous material may get brittle and inadvertently break upon handling if cooled to low temperatures. Preferably, temperatures of a cooling medium are in a range of between about 5 to 35 degree Celsius, preferably between 10 degree Celsius and 25 degree Celsius.

The apparatus according to the invention may comprise a shaping device having one or several static shaping elements, one or several dynamic shaping elements or a combination of static and dynamic shaping elements.

According to an aspect of the apparatus according to the invention, the shaping device comprises at least one static shaping element. In this context, static means that the shaping elements are stationary with respect to a transport direction of the substantially flat continuous material. In some preferred embodiments, the apparatus comprises static shaping elements only, that is, these embodiments of the apparatus do not comprise dynamic shaping elements as will be described further below. With static shaping elements the substantially flat continuous material or also a partially gathered material is formed by passing the static shaping element. This may facilitate an installation due to the avoidance of movable device parts. This may advantageously reduce wear of the machine parts and maintenance.

In some preferred embodiments a static shaping element is a garniture tongue for shaping the substantially flat continuous material into a rod shape. The cooling device is arranged next to an outlet opening of the garniture tongue and comprises a contact surface for contacting the gathered web of material leaving the garniture tongue. In general, in garniture tongues, friction is high between the material being formed and the inner walls of the garniture tongue. Thus, cooling is provided immediately after the rod-formation in the garniture tongue to stop or prevent changes in the material caused by frictional heat.

Preferably, the contact surface of the cooling device contacts the gathered or rod-shaped material along a predefined length of the gathered material. The contact surface may have a form corresponding to the form of the gathered material leaving the garniture tongue. Preferably, the contact surface of the cooling device has a longitudinal concave shape, for example a tunnel shape covering a portion over a predefined length of the gathered material. Such a tunnel shaped contact surface of a cooling device may also replace an end portion of a garniture tongue.

The static shaping element or a further static shaping element may be constructed as at least one structured surface, wherein the structure has a longitudinal extension in a transport direction of the substantially flat continuous material. A continuous material is guided along the structure of the material and thereby formed and gathered according to the structure. Preferably, the substantially flat continuous material is successively gathered in a direction transverse to a transport direction of the substantially flat continuous material while passing between the structured surface of the static shaping element and a counter element arranged opposite the structured surface. The counter element may have a substantially flat surface or a surface comprising a structure, preferably a structure corresponding to the structure of the surface of the shaping element. Preferably, such corresponding structures may engage each other. The substantially flat continuous material may be cooled by the static shaping element, that is, while the continuous material passes along the structured surface of the static shaping element.

The structure of a surface of a static shaping element may for example at a specific longitudinal position be the same over an entire width of the surface or may be different along the width of the surface (the width of the surface is seen with respect to the width of the continuous material). For example, a structure in a center of a shaping element may be higher than in lateral regions. By this, friction due to a lateral movement of continuous material passing this structure may be lowered. Thus heat production due to friction may also be lowered.

There may also be provided two or a series of static shaping elements having a structured surface. Preferably, the static shaping elements of a series are arranged along the transport direction of the continuous material. A distance between the individual shaping elements may vary and may be chosen according to a desired gathering result to be achieved. In a series of static shaping elements, the structures of the individual static shaping elements may be different, for example with respect to a height or spacing of structures of the shaping elements. Parting the shaping section into individual assemblies may advantageously reduce the complexity of manufacturing the structure, in particular for curved or other non-flat structure surfaces. Further, advantageously, individual sections may be replaced according to need under wear as opposed to the need to replace the entire shaping structure, reducing for example the cost for spare parts. Further, it may be sufficient to guide the web of substantially flat continuous material during the shaping step only between about 20 percent and about 50 percent of the length in a transport direction of the shaping structure. In some embodiments, the shaping structure may comprise an upper structure and a corresponding lower structure and one of the upper or lower structure is provided only partially, for example along between about 20 percent and about 50 percent of the length in a transport direction of the shaping structure as supporting points. This may further allow additional access to the web of substantially flat continuous material within the shaping structure, for example to allow a cooling medium to reach the web of substantially flat continuous material.

As a general rule, whenever the term "about" is used in connection with a particular value throughout this application this is to be understood such that the value following the term "about" does not have to be exactly the particular value due to technical considerations. However, the term "about" used in connection with a particular value is always to be understood to include and also to explicitly disclose the particular value following the term "about".

One or a series of static shaping elements having structured surfaces may for example be cooled by cooling the shaping element. A material passing the shaping element(s) is automatically cooled upon contacting the cool structured surface of the shaping element. A cooling medium, such as a gas stream, may also be led to the continuous material, for example through apertures in a structured surface of a shaping element. Such a gas stream may also be provided to support a transport of the continuous material, for example by shaping an air cushion the continuous material may glide on.

According to another aspect of the apparatus according to the invention, the shaping device comprises a dynamic shaping element capable of performing a movement in a transport direction of the substantially flat continuous material.

Dynamic shaping elements can be moved in the same direction as the continuous material. By this, a relative movement between continuous material and shaping element is reduced. This may reduce friction and heat production related to friction.

In some preferred embodiments, a dynamic shaping element comprises at least one pair of shaping rollers, wherein the rollers of the pair of shaping rollers are rotatable in a transport direction of the substantially flat continuous material. The shaping rollers have circumferentially arranged structures on a periphery of the shaping rollers for shaping the continuous material passing between the pair of rollers. The rotational axis of the pair of shaping rollers are arranged along the width of the continuous material and such that the structures are aligned in transport direction of the continuous material. Preferably, the circumferentially arranged structures have decreasing heights from a central portion of the shaping rollers (central portion of the continuous material) to a lateral portion of the rollers (lateral portion of the continuous material). By this, friction, and thus heat production, due to a lateral movement of the continuous material may be reduced. Also the shaping rollers may be cooled.

A dynamic shaping element may comprise a series of pairs of shaping rollers. The pairs of shaping rollers of the series are arranged in parallel. Structures on the circumference of shaping rollers may be different between different pairs of shaping rollers of the series of pairs of shaping rollers. Preferably, different structures on shaping rollers are adapted to a position of the shaping rollers in the apparatus (further upstream or downstream of a transport direction of the continuous material) and to an extent of gathering of the continuous material.

The shaping device may comprise a conveyor unit for shaping the substantially flat continuous material preferably into a round shape. The conveyor unit comprises at least two subsequently arranged dynamic shaping elements in the form of at least two gathering rollers having a rotational axis perpendicular to a transport direction of the continuous material. Preferably, the gathering rollers have a circumferentially running groove for moving the substantially flat continuous material in the grooves and between each of the gathering rollers and an oppositely arranged guide element. The at least two gathering rollers with oppositely arranged guide element are arranged at a distance to each other along the transport direction of the substantially flat continuous material. A distance between gathering roller and guide element may be varied, for example by a lateral displacement of the gathering rollers or the guide elements or by both. By such a lateral displacement an extent of width reduction of the continuous material may be variably set. This increases the flexibility in the adjustment of the gathering rollers with regard to, for example, the width of the web of substantially flat continuous material. The width of the substantially flat continuous material may differ between production runs, for example due to different target densities of the gathered substantially flat continuous material. Further, lateral guide elements are advantageous in alignment of the substantially flat continuous material web in a transversal direction, for example to compensate for a transversal drift of the material during production. The web of substantially flat continuous material may show transversal drift in particular after a step of structuring the substantially flat continuous material, for example by crimping, which reduces the transversal stability of the substantially flat continuous material web.

Preferably, the grooves of the at least two gathering rollers have a different shape. For example, the groove of a more downstream arranged gathering roller has a shape, which may correspond to a final shape of the continuous material or substantially correspond to a final shape of the continuous material. For example, if the final shape is a rod-shape, the groove of a more downstream arranged gathering roller may have a shape, which is substantially circular, while the groove of a more upstream arranged gathering roller may have a form, which is more oval.

In a conveyor unit as described herein, a substantially flat continuous material is formed and partially gathered with and according to the first gathering roller. The partially gathered continuous material is further gathered by the subsequently arranged gathering roller. With the conveyor unit a substantially flat continuous material may subsequently and stepwise be shaped to a final shape, preferably rod-shape. The dynamic gathering rollers provide for low friction, limiting the production of heat. Further, the sequentially arranged gathering rollers allow for improved control over the shaping process of the continuous material. Thus, a folding of the continuous material may be made more reliable and reproducible products, for example, having reproducible RTD, may be manufactured.

The oppositely arranged guide element or guide elements may be stationary. For example, the oppositely arranged guide elements may be wall elements or a single wall element. Oppositely arranged guide elements may also be moveable, for example may also be in the form of gathering rollers having a groove. Preferably, each of the guide elements or the oppositely arranged gathering rollers is provided with a groove having a shape corresponding to a shape of the groove of the oppositely arranged gathering roller.

In some preferred embodiments, the at least two gathering rollers are each an element of a roller couple. Each gathering roller of a gathering roller couple has a rotational axis perpendicular to a transport direction of the sheet material and has a circumferentially running groove for transporting the substantially flat continuous material between the gathering rollers of a gathering roller couple and in oppositely arranged grooves. Preferably, a distance of and between the gathering roller couples, or also between a gathering roller and its oppositely arranged guide element, may be variable to define an extent of a gathering of a continuous material.

Preferably, the shaping device comprises at least two different dynamic shaping elements, which are arranged subsequently and at a distance to each other along the transport direction of the substantially flat continuous material. The at least two different dynamic shaping elements may then, for example, each comprise one pair of shaping rollers having circumferentially arranged structures on a periphery of the shaping rollers. The at least two subsequently arranged dynamic shaping elements may, for example, also be part of a conveyor unit of the shaping device for shaping the substantially flat continuous material preferably into a round shape. The at least two subsequently arranged dynamic shaping elements are then in the form of at least two gathering rollers having a rotational axis perpendicular to a transport direction of the substantially flat continuous material and having a circumferentially running groove.

In order for the two dynamic shaping elements to be different, for example, a groove of a more upstream arranged gathering roller has a shape, which is different from the shape of a groove of a more downstream arranged gathering roller. The dynamic shaping elements are different, for example, having a different shaping structure or being arranged relative to a transport direction and position of the continuous material, such as to achieve a different gathering of the continuous flat material when the continuous material passes the first of the at least two dynamic shaping elements and the second of the at least two dynamic shaping elements. Advantageously, a different gathering is a gathering to a different extent but may also be a gathering in different sections over a width of the continuous material, including the providing the continuous material with a different gathering structure.

According to a further aspect of the apparatus according to the invention, the apparatus further comprises a parting unit for creating an open channel in the gathered continuous material. The parting unit comprises a parting element, which is arranged relatively movable to a transport direction of the substantially flat continuous material or the gathered material, respectively. The parting element is arranged such as to extend at least partly into the gathered continuous material. The dynamic parting unit again provides less friction than for example a static parting element such as a parting finger. Thus, less heat is produced by the parting unit having a movable parting element.

An open channel created by the parting unit may for example serve for the introduction of an object, such as for example a capsule or thread. An introduced object may for example serve flavoring, colouring or filtration purposes. The parting element may additionally be cooled.

In some preferred embodiments of the parting unit, the parting unit comprises a pair of parting rollers arranged in parallel and rotating in transport direction of the substantially flat continuous material. The pair of parting rollers defines a passage between the two parting rollers of the pair of parting rollers. The parting element is a parting disc arranged around the circumference of one of the parting rollers of the pair of parting rollers and extends into the passage. The continuous material passes through the passage formed between the parting rollers.

A parting unit may also serve as shaping unit. For example, a passage between parting rollers may be shaped according to an intended shaping of the continuous material passing between the two parting rollers. For example, a passage may be oval shaped.

A parting unit may for example be arranged between two subsequently arranged dynamic shaping elements, for example between two gathering rollers of a conveyor unit as described above. Thus, an object may be introduced into a partially gathered material. The partial gathering still allows the insertion of an object, however, the partial gathering may also limit a displacement of the introduced objected in the continuous material. This allows for high precision in the alignment of the object within the gathered material. With the subsequently arranged gathering roller, the continuous material is further gathered and the object fixed in the material. If the parting roller is cooled, its cooling action may support a cooling of the continuous material upon gathering in the conveyor unit.

In general, any static or dynamic shaping element may be cooled for supporting the reliable gathering and shaping of the continuous material, in particular of material having low melting temperature or low glass transition temperature or both a low glass transition temperature and a low melting temperature.

One or several embodiments of the apparatus according to the invention may be arranged along a treatment line for substantially flat continuous material. Therein, embodiments having different shaping devices and having different cooling devices may be combined. An apparatus may also comprise one or several shaping devices arranged further downstream or upstream of a material treatment line. The several shaping devices may be arranged next to each other or may have one or several other material treatment steps performed in between the shaping devices. Preferably, more than one shaping device, preferably two to three shaping devices as described herein are arranged along a treatment line. Shaping devices having static shaping elements may be combined with shaping devices having dynamic shaping elements. Static shaping elements may be exchanged with dynamic shaping elements according to a required material treatment process. Shaping devices combined with cooling devices, for example having cooled contact surfaces or cooled shaping elements may be combined with shaping devices with no cooling. Shaping devices providing the continuous material with a structure may be combined with shaping devices that push the continuous material together.

According to another aspect of the invention, there is also provided a method for shaping an initially substantially flat continuous material. The method comprises the steps of providing a substantially flat continuous material and gathering the substantially flat continuous material in a lateral direction to form a gathered continuous material. The method further comprises the step of cooling the substantially flat continuous material while gathering the substantially flat continuous material or immediately after gathering the substantially flat continuous material.

The step of gathering the substantially flat continuous material may comprise successively gathering the substantially flat continuous material in a direction transverse to a transport direction of the web of material. The gathering step may be combined by the cooling step, for example, by cooling the substantially flat continuous material while passing the substantially flat continuous material along a structured surface of a static shaping element.

The gathering step may comprise successive gathering through passing the substantially flat continuous material between at least a roller couple having circumferentially arranged structures. Thereby, the structure of the shaping rollers is superimposed onto the continuous material. In another variant of dynamic shaping elements, the continuous material is gathered in a lateral direction by guiding the material along different forms of grooves arranged in subsequently arranged gathering rollers.

The steps of gathering and cooling the substantially flat continuous material may also comprise shaping a rod-shaped continuous material and cooling the rod-shaped continuous material by a cool contact surface in contact with the rod-shaped continuous material.

The method may further comprise the step of parting gathered continuous material, wherein the step of parting is performed by inserting a disc into the gathered continuous material, wherein the disc is adapted to be rotatable along the transport direction of the substantially flat material. Preferably, parting is performed after the continuous material has partially been gathered in one or several shaping devices and before a last shaping device for gathering or shaping the continuous material into its final shape.

In some preferred embodiments, the gathering of the substantially flat continuous material is performed by means of a static shaping element and cooling is performed immediately after gathering the continuous material. Thereby, the cooling is achieved by a cool contact surface in contact with the gathered continuous material arranged next to an outlet of the static shaping element. Preferably, the continuous material is gathered into a rod shape and the rod-shaped material is then cooled.

In some preferred embodiments, the gathering is performed by means of at least two subsequently arranged dynamic shaping elements to subsequently form a gathered continuous material. Cooling the substantially flat continuous material is performed while gathering the substantially flat continuous material or immediately after gathering the substantially flat continuous material. The method also comprises the step of arranging the at least two dynamic shaping elements at a distance to each other along the transport direction of the substantially flat continuous material, wherein the at least two dynamic shaping elements are arranged or comprise shaping structures such that the continuous material is gathered to a different extent by the two dynamic shaping elements.

As already outlined above, gathering to a different extent may comprise gathering the continuous material with the at least two different dynamic shaping elements to one or a combination of different widths, different overall shapes or providing the continuous material with different dimensions of a shaping structure.

Advantages and further aspects of the method according to the invention have been described relating to the apparatus according to the invention and will therefore not be repeated.

The apparatus and method according to the invention are in particular suited for materials having a low glass transition temperature. In preferred applications, the continuous material formed in the apparatus and according to the invention has a glass transition temperature of below 150 degree Celsius, for example below 100 degree Celsius. Preferably, the continuous material is a plastics material, for example polylactic acid. The continuous material may be a crimped continuous material.

The invention is further described with regard to embodiments, which are illustrated by means of the following drawings, wherein.

Figure 1:
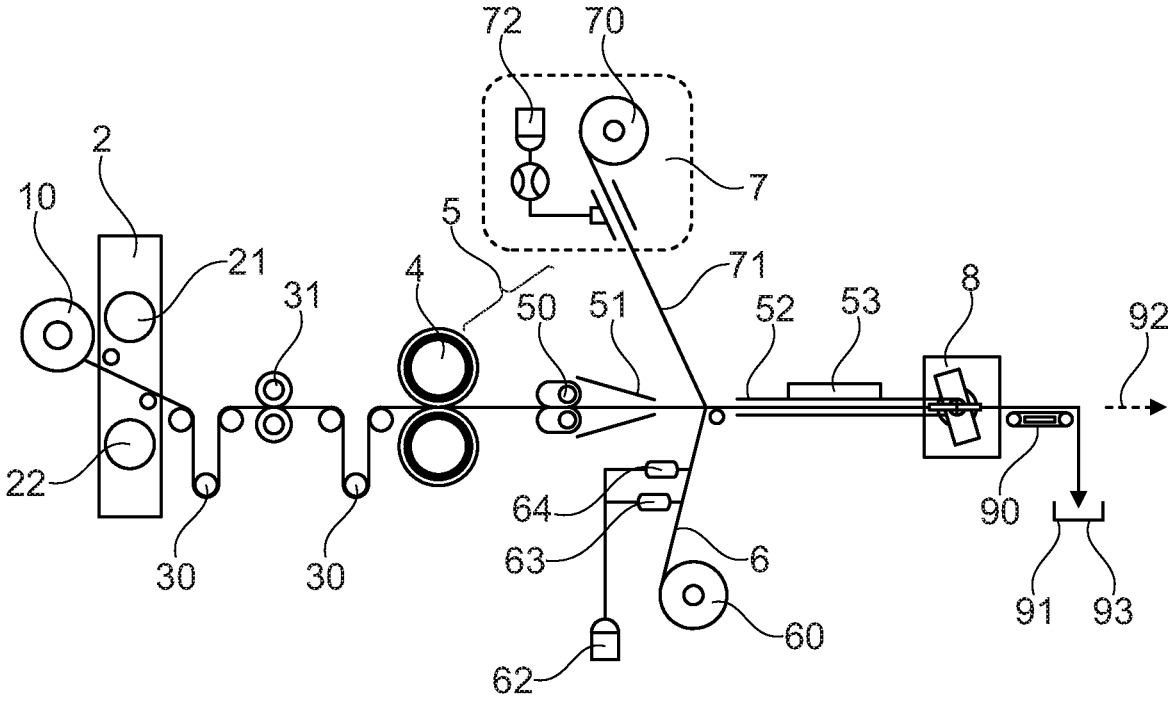
FIG. 1 shows a schematic overview of an embodiment of a filter making apparatus.

In the filter making apparatus schematically shown in FIG. 1, a substantially flat continuous material such as a web of material 1 is provided on a bobbin 10. When unwound from the bobbin 10, the web 1 is crimped, gathered and cooled and wrapped in the apparatus. In this embodiment, the web 1, for example a polylactic acid (PLA) film, passes a corona module 2 directly after having been unwound from bobbin 10. In the corona module 2, both sides of the web 1 are subsequently corona treated in two corona module portions 21,22. Corona treatment enhances wettability of the web 1 with an adhesive for improving anchoring of the folded web in its wrapper. After corona treatment, the web 1 passes a crimping device 4, for example a set of two crimping rollers. The crimping device 4 provides the web with a crimping structure, for example with substantially parallel corrugations running, preferably, in longitudinal direction of the web, that is, in transport direction of the web 1. The crimping rollers may be cooled. The web 1 then passes a shaping device 5. The shaping device 5 comprises shaping rollers 50, preferably providing the crimped web 1 with a longitudinally running wave-like macro structure overlaying the crimping micro structure. Imposing the overlaying macro structure onto the web 1 causes the web 1 to be pushed together in a transverse direction of the web 1. In addition, a gathering of the web 1, for example into a rod shape, is supported by the longitudinal wave-like structure and may be performed in a more controlled manner. The shaping device also comprises a funnelling device 51 arranged downstream of the shaping rollers 50. In the funnelling device 51, the web 1 is further shaped into rod-shape, for example by gathering or pushing together. The shaping device 5 or parts of the shaping device are cooled. Preferably, when leaving the funnelling device 51, the web 1 has not yet achieved its final form, or is not entirely gathered, respectively. This facilitates the introduction of an object, such as for example a capsule or flavoured thread 71, into the endless rod of web material. A flavour application system 7 comprising an endless thread 71 and a flavour reservoir 72 is arranged downstream of the shaping device 5. The thread 71 is mounted on a bobbin 70. Preferably, the flavour reservoir 72 contains menthol. The thread 71 is unwound from the bobbin 70 and entrained with flavour before being transported to the gathered web 1. The flavour application system 7 may be provided with at least one of a flow meter, a valve, a temperature control and a pump for control of a defined amount of flavor to be applied to the thread 71. The flavour application system 7 is arranged above the web 1 in order for gravity to support the introduction of the thread into the web. Gravity may also support a flow of flavouring liquid along the thread 71. Alternatively, or in addition, flavour may be added separately from the thread 71 or may be entirely omitted. In that case, the presence of the thread may have mostly an aesthetic contribution to the aerosol-generating article.

An endless wrap material 6, for example paper, is provided on a bobbin 60 and supplied from below the endless rod such that the endless rod of web material comes to lie on the wrap material 6. The wrap material 6 runs parallel to the endless rod when being joined with the rod. Before the wrap material 6 and the endless rod are joined, the wrap material is provided with glue. A glue reservoir 62 is in fluid connection with a seam nozzle 64 as well as with an anchor nozzle 63. Glue from the glue reservoir 62 is transported via a glue conduit, for example a tube, to the anchor nozzle and the seam nozzle. With the anchor nozzle 63, anchoring glue is applied to the wrap material such that the wrapper may securely be glued to the web material. With the seam nozzle 64, seam glue is applied to the wrap material 6, for gluing the wrap material to itself after the wrap material has been entirely wrapped around the endless rod of web material. In this embodiment, the glue reservoir 62 contains a glue, which may be used for both the anchoring and the seaming of the wrap material.

However, if different glue shall be used, a reservoir each for the anchoring and for the seaming may be provided. Different glues may be advantageous, for example, if a wrap material is a paper wrapper and paper glue shall be used for the seam and if, for example, specific plastics glue shall be used for the anchoring of the wrapper to a plastics web material of the endless rod. Also, glues may vary with respect to the setting time for the glue. For example a polyurethane glue and a hot-melt glue may be used for different purposes.

The wrapped endless rod of web material may be guided in a rod-shaped bed 52 passing a heating device 53 for heating the wrapped endless rod. The heating facilitates a distribution and fast drying of the glue. After the endless rod has been formed, it is cut in the cutting device 8 into rod segments of predefined length, for example single or double length segments (having the length or the double length of a final product). The cutting device or a cutting knife of the cutting device may be cooled. The rod segments may be transported to a tray or storage 91. The rod segment may also directly be transported to a combiner 92 for being combined with further elements, for example further filter elements or segments of, for example, aerosol generating articles.

An online control unit 90 is provided after the endless rod has been cut into segments for a quality control of the manufactured segments. At the location of the tray 91, there may be provided an offline control unit 93. An online control unit 90 and offline control unit 93 may, for example, include a length control, diameter control, a weight control, ovality control, control for a resistance to draw (RTD), the thread centering and other visual quality aspects of the semi-finished or finished good. The offline control unit 93 may for example also be provided with a measuring device for a menthol content or other substances in the rod segment. In the tray 91, the segments may be labelled, for example with a batch number, production date or product code, for example, for tracking of the products.

Preferably, tension rollers 30 and driving rollers 31 are provided in the apparatus for a controlled transport of the web of material 1 and a continuous, preferably constant, tensioning of the web. Synchronization means may be provided between crimping device 4 and a transport means such as a continuous belt, for example, at the position of the online control unit 90. By the synchronization means a linear speed of the endless rod and of the yet to be gathered substantially flat continuous material fed into the crimping device 4 may be synchronized.

Figure 2:
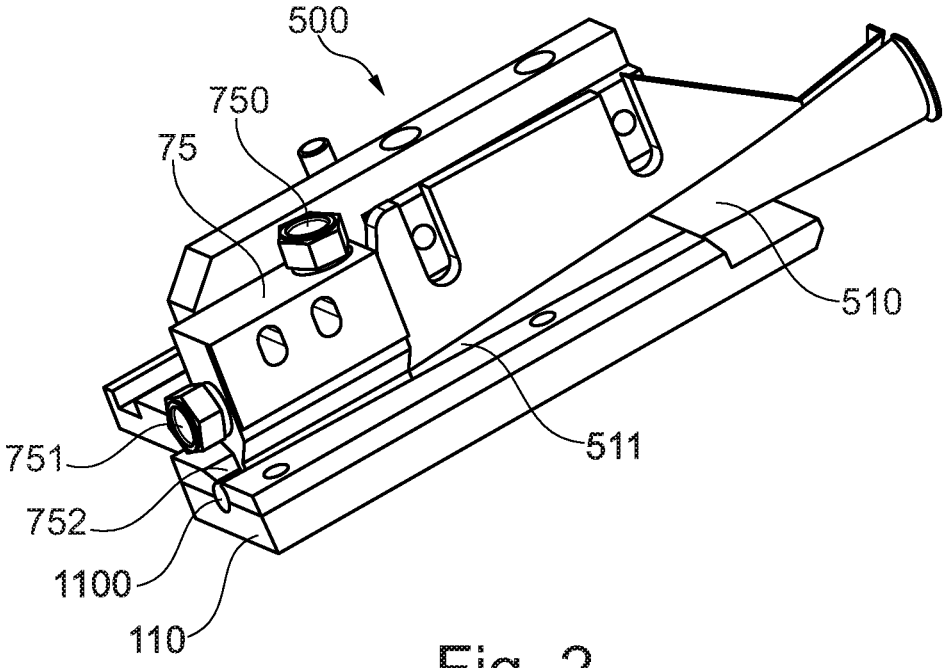
FIG. 2 illustrates a static shaping device with cooling device.

FIG. 2 is an embodiment of a static shaping device 500 comprising a cooling device in the form of an intercooled finger 75. A garniture tongue 510 as known in the art for shaping the web 1 into a rod-shape has a cut end portion 511. The intercooled finger 75 is arranged directly adjacent to and aligned with the cut end portion 511 of the garniture tongue 510. The intercooled finger 75 is provided with a cooling surface 752 directly contacting the web guided within the shaping device.

The intercooled finger 75 comprises a cooling fluid inlet 750 and a cooling fluid outlet 751 for guiding a cooling fluid, for example air or liquid, into the intercooled finger 75. Preferably, the intercooled finger 75 is made of a thermally conductive material such that at least the cooling surface 752 is cooled via heat conduction from the cooling liquid to the cooling surface.

Figure 3:
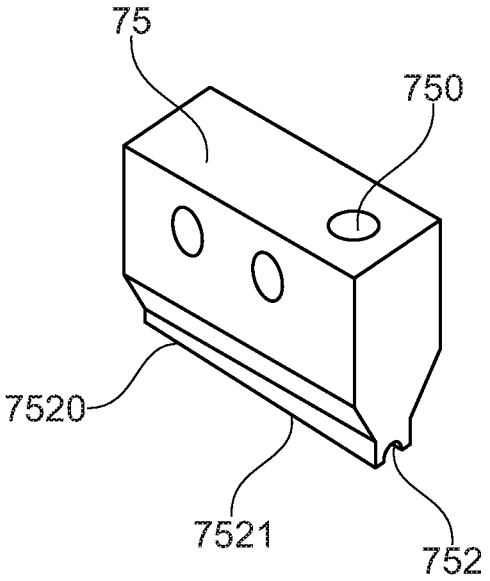
FIG. 3 shows a detail of the cooling device of FIG. 2.

The cooling surface 752 has a concave shape such as to keep the web 1 in contact with the cooling surface 752 in the rod shape. As shown in more detail in FIG. 3, the shape of the cooling surface 752 varies along the length of the cooling device 75. The cooling surface 752 is provided with a narrowing radius of curvature versus a downstream end 7520 of the surface such as to further form the web 1 into a rod shape. The cooling surface 752 has a continuously diminishing height 7521 along the length of the cooling device 75. Thus, the cooling surface 752 is arranged askew relative to a horizontal support 110 relative to the transport direction of the web. The web 1 is guided continuously in the garniture tongue 510 and the cooling device 75. A support 110 the web 1 is guided along comprises a longitudinal groove 1100 in the form of a half circle for receiving the rod-shaped web.

The cooling surface 752 may also have a constant shape and orientation along the length of the intercooled finger 75.

Figure 4:
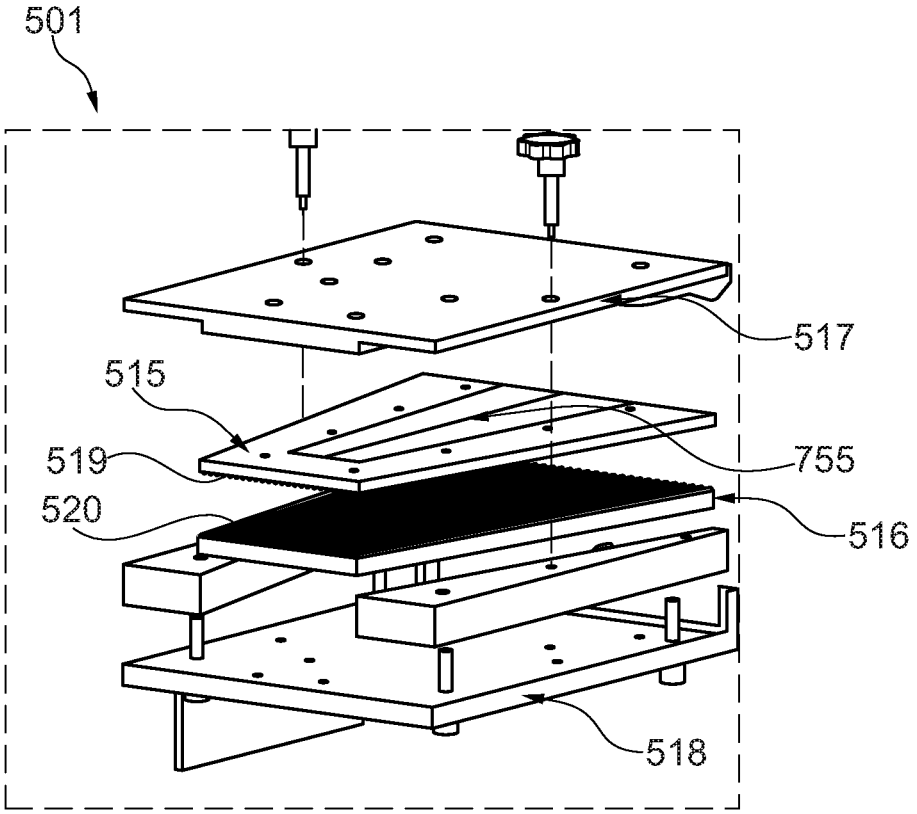
FIG. 4 shows an exploded view of a static shaping device with integrated cooling.

FIG. 4 shows another static shaping device 501 with integrated cooling system. The shaping device 501 comprises an upper and a lower shaping plate 515,516. The shaping plates comprise a plurality of longitudinally arranged structures 519,520 in the form of ridges and valleys. The ridges and valleys converge versus a downstream end of the plates. The structures 519 in the upper shaping plate 515 correspond to the structures 520 in the lower shaping plate. A continuous web of material 1 transported between the two shaping plates 515,516, for example a PLA foil, is progressively provided with a macro structure corresponding to the structures of the plates. A cover plate 517 and a base plate 518, by which the shaping device 501 may be assembled are preferably cooled by a refrigerated liquid (not shown). Preferably, all plates are made of a heat conductive material, such that the web 1 may be cooled by heat transfer via the plates 515,516,517,518. Preferably, the temperature of a PLA web is kept below 50 degree Celsius, preferably, below 40 degrees, most preferably, below 30 degrees.

Figure 6:
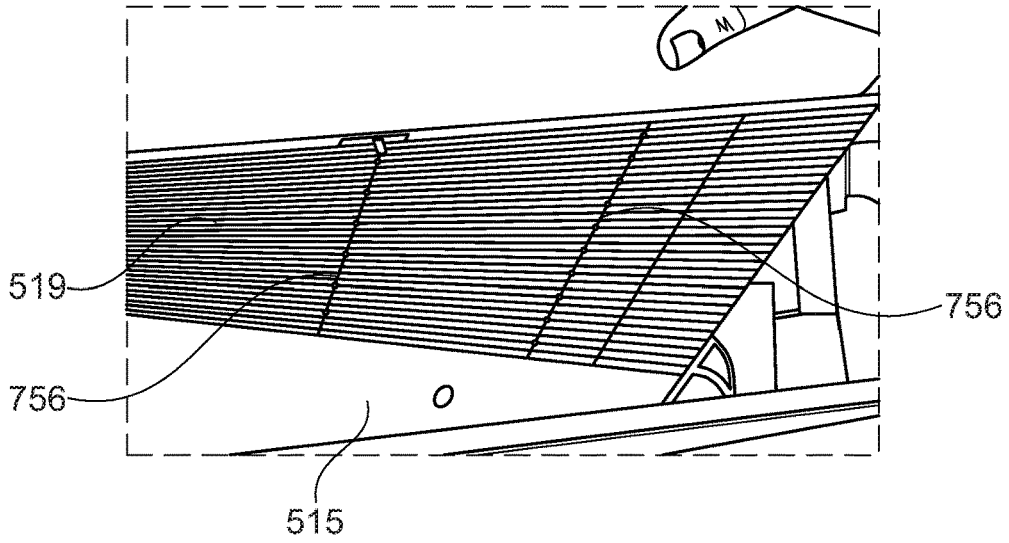
FIG. 6 shows a structured surface of the shaping device of FIG. 4.

Air slots 755 are provided in the back side of the shaping plates 515,516. In addition, several lines of air passage holes 756 are provided in the shaping plates as can be seen in FIG. 6. These lines of passage holes 756 are arranged at a distance to each other and transverse to the longitudinal structures 519,520 in the shaping plates 515,516. The air holes are in fluid communication with the air slots 755. Compressed air may be introduced into the slots 755 and made to pass through the holes 756 to support an entering of the PLA foil between the shaping plates 515,516. In addition, friction between the shaping plates and the web may be reduced and the web may additionally be cooled by the air.

Figure 5:
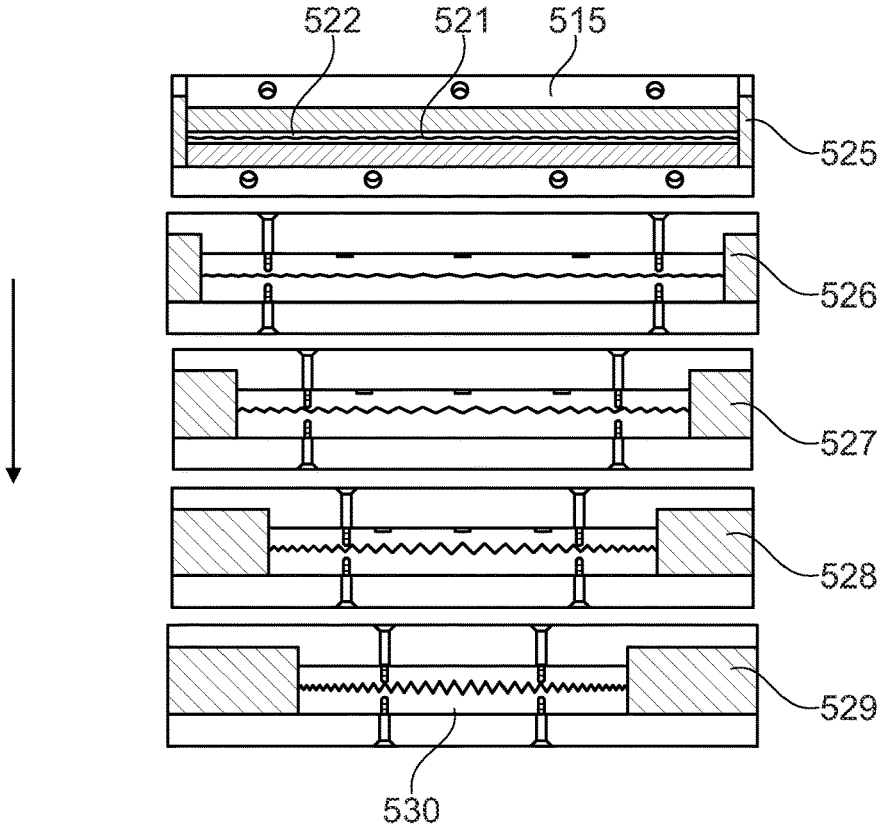
FIG. 5 is a series of cross sections through the shaping device of FIG. 4.

In FIG. 5 several cross sections 525-529 through the closed shaping plates 515,516 are shown. From top to bottom the cross sections refer to different longitudinal positions of the shaping plates 515,516 when seen in a transport direction of the web 1 (indicated by arrow). The structures 519,520 in the shaping plates 515,516 are more expressed in the center 521 of the plates than at lateral sides 522 of the plates. A height of the structure (ridges) continuously grows also towards a downstream direction. In this example, distances 530 between individual ridges or valleys remain constant.

The individual cross sections 525-529 may also correspond to cross sections of a series of individual static shaping elements arranged distanced to each other along the transport direction of the web 1. Several individual static shaping elements allow for, for example, a cooling by ambient air in between the individual shaping elements.

Figure 7:
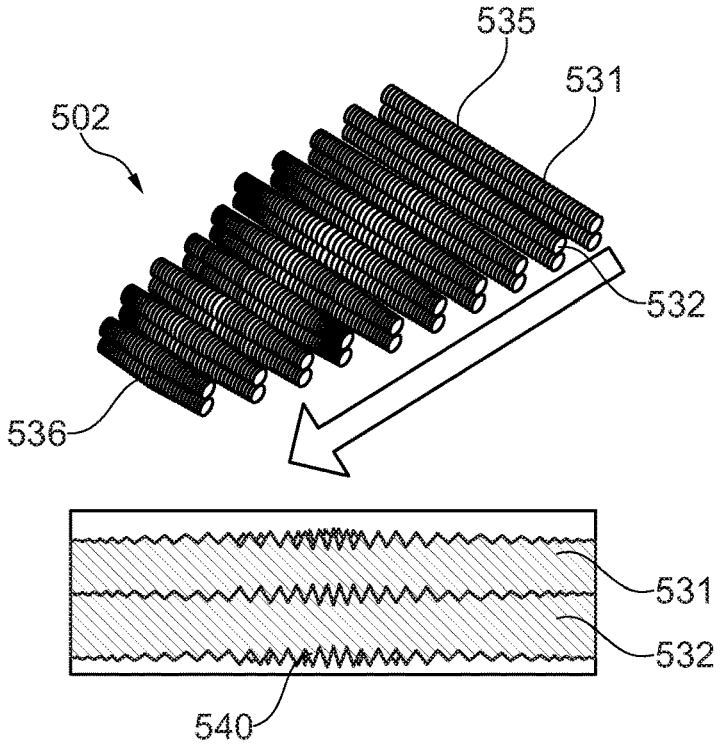
FIG. 7 shows a dynamic shaping device comprising shaping roller pairs.

FIG. 7 shows a dynamic shaping device 502, wherein a plurality of shaping roller pairs are arranged parallel to each other. The individual roller pairs are distanced from each other along the transport direction of the web. Upper and lower shaping rollers 531,532 comprise circumferentially running structures 535,536 corresponding to each other. The structures 535,536 defined by discs arranged in parallel along a length of a roller are more expressed in the center of the roller than at the lateral edges of the roller. The center of a web (midline) guided in between the shaping roller pairs is shaped more in the center than at the lateral edges of the web. A height of the structure 535,536 is increasing with progressing shaping of the web. In this example, a distance 540 between individual structures (discs) is decreasing from a center to the lateral edges of the shaping rollers 531,532.

The rollers 531,532 rotate along the transport direction of the web moving between the rollers, thus reducing friction between the rollers and the web. A cooling of the shaping rollers 531,532 may be provided.

Figure 8:
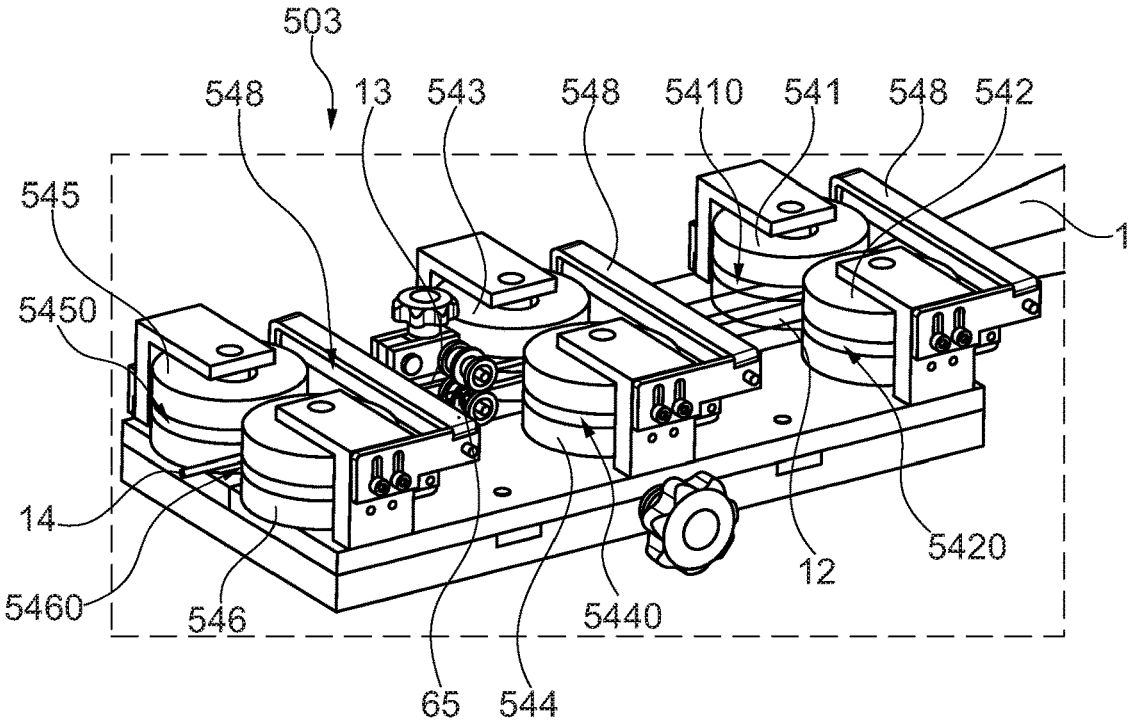
FIG. 8 shows a conveyor unit comprising pairs of gathering rollers.

The dynamic shaping device 503 of FIG. 8 comprises three gathering roller pairs. The pairs are arranged at a distance to each other along a transport direction of the web 1. Each of the pairs comprises two gathering rollers 541,542; 543,544; 545,546 arranged opposite each other and such as to rotate along the transport direction of the web. The gathering rollers each have a groove 5420,5410;5440;5460, 5450 arranged in their circumference. The gathering rollers have a rotational axis perpendicular to the transport direction of the web 1 such that the web is guided and gathered in and by the grooves of the gathering rollers 541,542; 543,544; 545,546 when passing through the shaping device 503. Preferably, the grooves 5420,5410;5440;5460,5450 of each roller pair have a similar shape. Preferably, the grooves of different pairs of gathering rollers have a different radius of curvature. The more downstream the roller pair the smaller the radius of curvature of the grooves. In an alternative embodiment, the grooves of different gathering roller pairs have an equal shape but the two gathering rollers of a pair are arranged at different distances between each other. In this alternative embodiment, the distance between gathering rollers of a roller pair arranged further upstream is larger than the distance between a pair of gathering rollers arranged further downstream.

The grooves 5410,5420 of the first and furthest upstream pair of gathering rollers 541,542 have an oval shape, the grooves 5440 of the second and middle pair of gathering rollers 543,544 have a half oval shape and the grooves 5450,5460 of the third and furthest downstream pair of gathering rollers 545,546 have a semi-circular shape. By this, the web of material 1 is stepwise gathered to an oval shape 12*a* up to a rod shape 14.

An auxiliary roller 548 is arranged upstream of each of the gathering roller pairs. The auxiliary rollers 548 are arranged above the web 1 and extend over the width of the web 1. The auxiliary rollers 548 support a positioning of the web for insertion into the dynamic shaping device 503, in particular into the grooves of the gathering rollers 541,542; 543,544; 545,546.

One gathering roller 542,544,546 of each pair of gathering rollers may be movable in a sideway direction. This may facilitate insertion of the web 1 into the shaping device 503 and maintenance of the device. Also a distance between rollers of a pair may thus be varied.

Some or all of the gathering rollers may be cooled.

Figure 9:
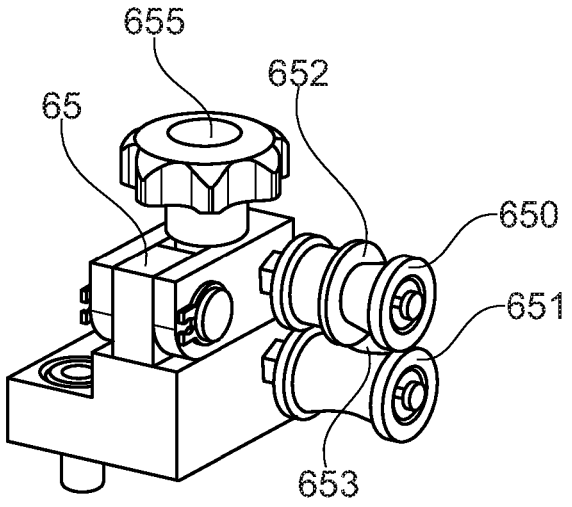
FIG. 9,10 is a side view and a cross sectional view of a parting unit.
Figure 10:
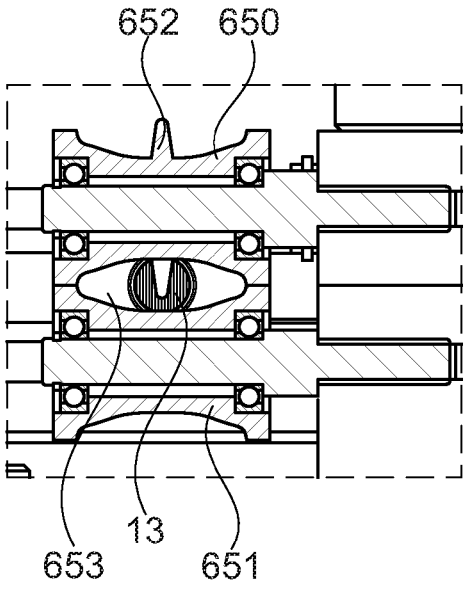

A parting unit 65 is arranged between the second and the third gathering roller pair. With the parting unit 65, the not entirely rod shaped web material 13 is parted for insertion of a flavouring object, for example a thread or a capsule (not shown). In FIG. 9 and FIG. 10, the parting unit is shown in more detail. Two parting rollers 650, 651 are rotatable in transport direction of the web 1. The parting rollers 650,651 have a rotational axis arranged parallel to the web, parallel to each other and perpendicular to the transport direction of the web 1. The parting rollers 650,651 have a concave shape as may be seen in the cross sectional view of FIG. 11. The upper parting roller 650 has a circumferentially running disc 652 arranged in the center of the shaping roller 650. The partially gathered web 13 is guided in and through the space 653 spanned between and by the two splitting rollers 650, 651. Thereby, the disc 652 of the upper roller 650 is inserted into the web and opens a channel in the web. The space 653 between the parting rollers 650, 651 may be varied and fixed in a defined position by adjustment knob 655.

Figure 11:
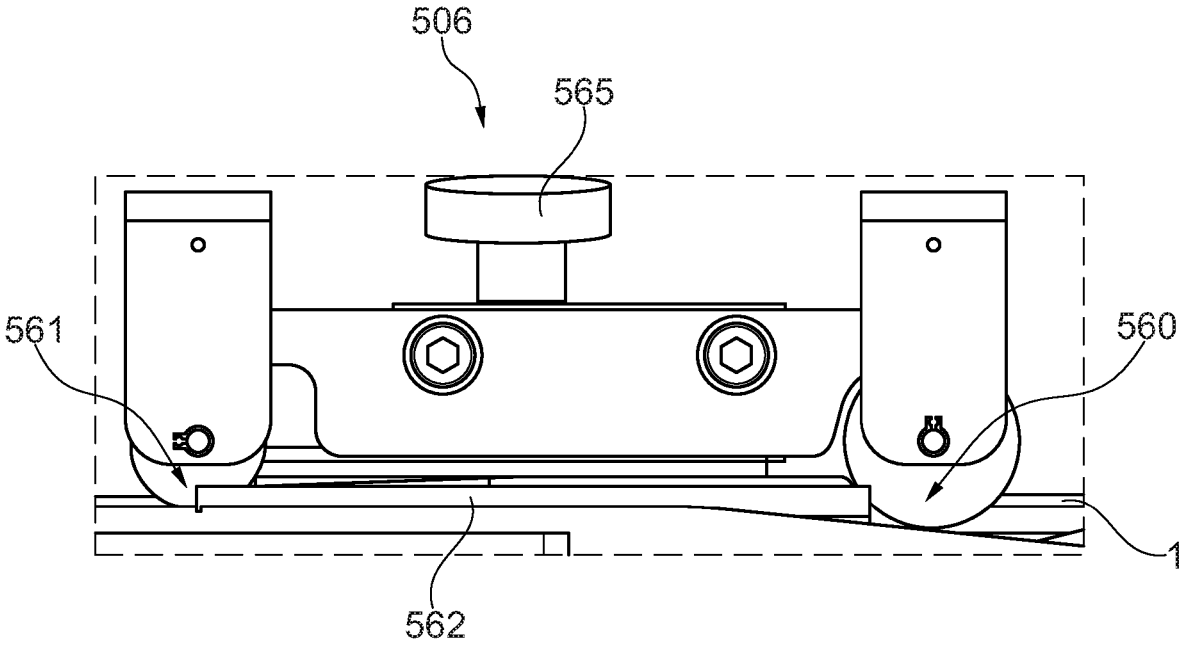
FIGS. 11-13 show a dynamic insertion unit and details of the insertion unit.

FIG. 11 shows an embodiment of a dynamic shaping device 506. Preferably, the shaping device 506 is arranged downstream of further shaping rollers, such that the web 1 entering the dynamic shaping device 506 of FIG. 11 already has a rod form or nearly rod form.

Figure 12:
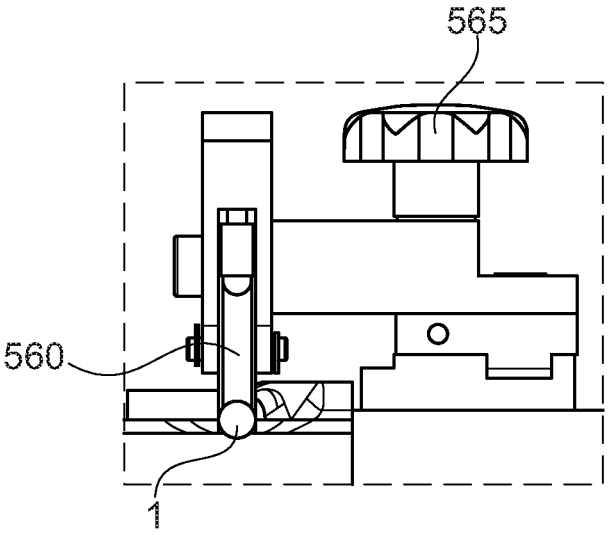
Figure 13:
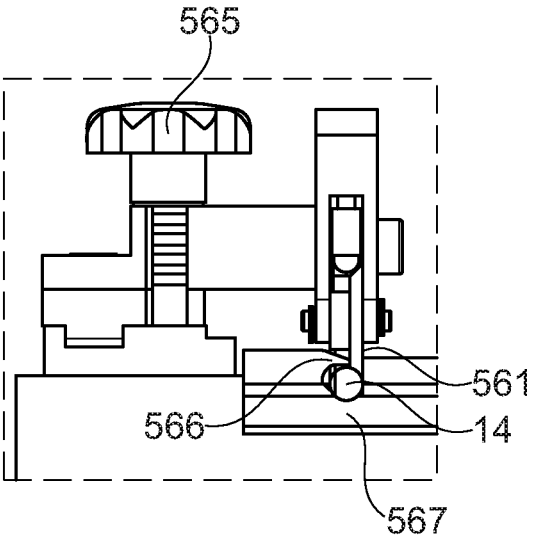

The shaping device 506 comprises two pre-shaping rollers 560,561. The pre-shaping rollers 560,561 are arranged and rotate in line with the web transported through the dynamic shaping device 506. As may be seen in FIG. 12, the more upstream arranged pre-shaping roller 650 is symmetric with respect to its shape contacting the web. The web 1 passing the symmetric pre-shaping roller 650 is guided in the concave shape of the circumference of the symmetric pre-shaping roller. As shown in FIG. 13, the more downstream arranged pre-shaping roller 561 is asymmetric with respect to its shape contacting the web. Only about a quarter of the circumference of the substantially rod-shaped web 14 is guided by the asymmetric pre-shaping roller 561, thus reducing the contact between roller and web.

A support 567 is provided with a longitudinal groove having a concave shape, wherein the substantially rod-shaped web is transported in. The support 567 also comprises a covering 566, partially covering the support and the web arranged in the groove. Preferably, the cover does not contact the web but serves as a retaining element keeping the web in the groove.

An adjustment knob 565 is provided for adjustment and setting of the pre-forming rollers 560,561 to a defined diameter value of the web passing through the dynamic shaping device 506. In addition, the dynamic shaping device 506 may be removed by loosening the adjustment knob 565. By this, material jam in the device may be removed in a fast and convenient manner.

The dynamic shaping device 506 may comprise further pre-shaping rollers arranged downstream of each other in the transport direction of the web. The further pre-shaping rollers may be of symmetric or asymmetric shape. One, several or all pre-shaping rollers 560, 561 may be cooled.

Preferably, the static shaping device 500 as shown in FIG. 2 is used as alternative to the dynamic shaping device 506 of FIG. 11.

Figure 14:
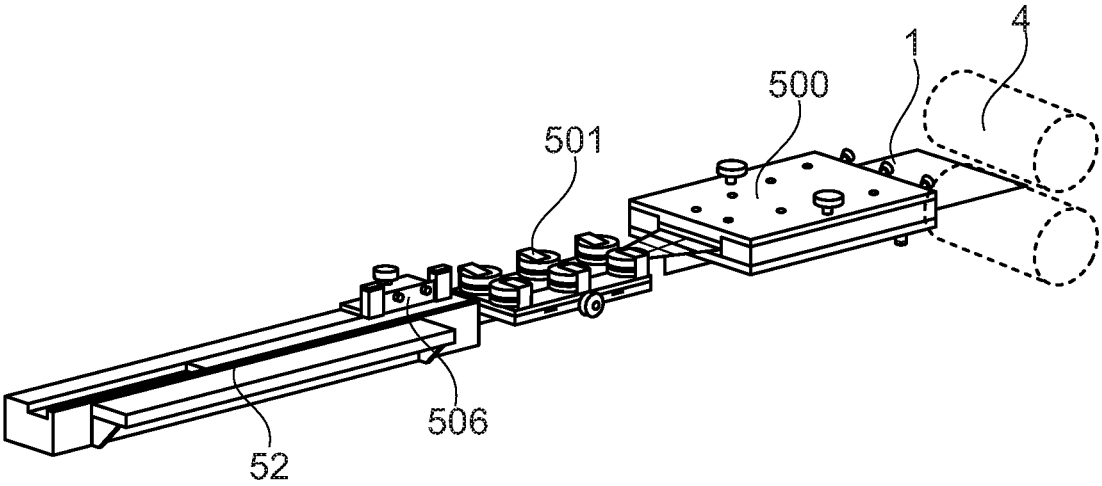
FIG. 14 shows a combination of shaping devices.

In FIG. 14 an exemplary combination of different shaping devices is shown. A web having passed schematically indicated crimping rollers 4 subsequently passes the static shaping device 500 and the two dynamic shaping devices 501 and 506. After leaving the most downstream shaping device 506, the web is supplied to the rod forming zone 52 which may be designed as known in the art and which is not further described. The web 1 is subsequently shaped into a rod shape by the shaping devices. Individual shaping device may be replaced by different shaping devices. For example, static shaping device 500 may be replaced by the dynamic shaping device of FIG. 7. Both shaping devices provide the web with a macro structure. The two dynamic shaping devices 500,501 may for example be replaced by the one static shaping device comprising a garniture tongue as shown in FIG. 2.

The invention claimed is:

1. Method for shaping a substantially flat continuous material, the method comprising the steps of:

providing a substantially flat continuous material of polylactic acid having a glass transition temperature of below 150 degree Celsius;

gathering the substantially flat continuous material by means of a static shaping element in a lateral direction to form a gathered continuous material;

cooling the substantially flat continuous material immediately after gathering the substantially flat continuous material, thereby cooling the gathered continuous material by a cool contact surface in contact with the gathered continuous material arranged next to an outlet of the static shaping element;

wherein the steps of gathering and cooling the substantially flat continuous material comprise shaping a rod-shaped continuous material and cooling the rod-shaped continuous material by a cool contact surface in contact with the rod-shaped continuous material, wherein the shape of the cool contact surface varies along its length in transport direction of the continuous material.

2. Method according to claim 1, wherein the step of gathering the substantially flat continuous material comprises successively gathering the substantially flat continuous material in a direction transverse to a transport direction of the substantially flat continuous material.

3. Method according to claim 1, further comprising the step of parting gathered continuous material, wherein the step of parting comprises inserting a disc into the gathered continuous material, wherein the disc is rotatable along the transport direction of the substantially flat continuous material.

4. Method according to claim 1, wherein the substantially flat continuous material has a glass transition temperature below 100 degree Celsius.

5. Method according to claim 3, inserting an object into the parted gathered continuous material.

6. Method according to claim 5, wherein the object is a capsule or a thread.

7. Method according to claim 1, therein cooling the substantially flat continuous material to a temperature below 50 degree Celsius.

8. Method according to claim 1, therein cooling the substantially flat continuous material to a temperature below 40 degree Celsius.

9. Method according to claim 1 therein cooling the substantially flat continuous material to a temperature below 30 degree Celsius.

10. Method according to claim 1, therein cooling the gathered continuous material by a concave cool contact surface.

11. Method according to claim 1, therein cooling the gathered continuous material by a cooling medium to a temperature below a predefined maximum temperature.

12. Method according to claim 1, wherein temperatures of a cooling medium are in a range between about 5 degree Celsius and about 35 degree Celsius.

13. Method according to claim 1, wherein temperatures of a cooling medium are below 35 degree Celsius.

14. Method according to claim 1, wherein temperatures of a cooling medium are in a range between 10 degree Celsius and 25 degree Celsius.

15. Method according to claim 9, wherein the cooling medium is a cooling gas or a cooling liquid.

16. Method according to claim 11, wherein the cooling medium is air or water.

* * * * *